United States Patent [19]

Grünwald et al.

[11] 4,393,282

[45] Jul. 12, 1983

[54] ELECTRODE FOR IGNITION SYSTEMS

[75] Inventors: Werner Grünwald, Gerlingen; Ernst Zehender, Althengstett; Karl-Hermann Friese, Leonberg; Jürgen Schmatz, Ludwigsburg; Hans Neu, Vaihingen; Kuno Kirner, Gerlingen; Bernd Schumacher, Vaihingen-Aurich, all of Fed. Rep. of Germany

[73] Assignee: Robert Bosch GmbH, Stuttgart, Fed. Rep. of Germany

[21] Appl. No.: 245,170

[22] Filed: Mar. 18, 1981

Related U.S. Application Data

[63] Continuation-in-part of Ser. No. 75,906, Sep. 17, 1979, abandoned.

[30] Foreign Application Priority Data

Oct. 26, 1978 [DE] Fed. Rep. of Germany ..... 2846590

[51] Int. Cl.[3] ..... H01H 19/00

[52] U.S. Cl. ..... 200/19 R; 200/19 A; 200/19 DC; 338/66

[58] Field of Search ..... 200/19 R, 19 DC, 19 DR; 338/66

[56] References Cited

U.S. PATENT DOCUMENTS

| | | | |
|---|---|---|---|
| 3,949,721 | 4/1976 | Hori et al. | 200/19 R |
| 4,007,342 | 2/1977 | Makino et al. | 200/19 R |
| 4,039,787 | 8/1977 | Hori et al. | 200/19 R |
| 4,074,090 | 2/1978 | Hayashi et al. | 200/19 DR |
| 4,091,245 | 5/1978 | Komiyama et al. | 200/19 R |
| 4,135,066 | 1/1979 | Yamanaka et al. | 200/19 DC |
| 4,175,144 | 11/1979 | Hori et al. | 200/19 R |
| 4,177,366 | 12/1979 | Kozuka et al. | 200/19 DR |
| 4,217,470 | 8/1980 | Kirner | 200/19 R |

FOREIGN PATENT DOCUMENTS 52-156240 12/1977 Japan .

*Primary Examiner*—R. L. Moses
*Assistant Examiner*—Morris Ginsburg
*Attorney, Agent, or Firm*—Frishauf, Holtz, Goodman & Woodward

[57] ABSTRACT

The part of the distributor electrode in the breakdown region has a resistance of at least 400 ohms per millimeter. The total resistance of the electrode is in the range of between 0.5 and 1.0 kilo-ohms. The material is a mixture of a resistive ceramic material and a finely dispersed additive of metallic conductivity. Arrangements for creating surface discharge gaps thereby slowing down the sparking process and decreasing interference are also illustrated.

25 Claims, 7 Drawing Figures

ELECTRODE FOR IGNITION SYSTEMS

This application is a Continuation-in-Part of prior application Ser. No. 75,906, filed Sept. 17, 1979, abandoned.

The present invention relates to electrodes and in particular, to electrodes used in the rotor and stator of the distributor in an ignition system of an internal combustion engine.

BACKGROUND AND PRIOR ART

Suppression of electrical interference in an ignition system is the more effective the smaller the rate of increase of current and the smaller the peak current value. It has been proposed to use as the material for the distributor electrodes a lanthanum chromite ceramic whose resistivity is in the range of between 0.1 and 100,000 ohm-centimeters (see Japanese Patent Publication 52-156 240 of Dec. 26, 1977).

THE INVENTION

It is an object of the present invention to dampen the breakdown across the spark gap, that is, to slow down the transition between the initial spark breakdown or ignition and the burning phase of the spark thereby decreasing high frequency interference. It is a further object of the present invention to accomplish this goal at a lower cost than is presently required for interference suppression.

The present invention is based on the realization that for the above-described purposes the total value of the damping resistance is not as important as an optimal resistance per millimeter of the resistive electrode. The improved electrode structure of the present invention is therefore a structure which has a predetermined minimum resistance per unit length, this predetermined minimum value being 400 ohms per millimeter. With this electrode, a decrease of interference of up to 20 decibels relative to the conventional arrangements results, while the costs are considerably smaller.

Additionally the overall resistance of the electrode should be at least 0.5 kiloohms, but should preferably lie in the range of between 0.5 and 1.0 kiloohms. A particular type of construction allows ready matching of the electrode to the parameters of the system in which it is being utilized. Specifically, the electrode is constructed of a plurality of sections, each section being limited in resistance value and thickness so that breakdown does not occur during ignition.

Interference is further decreased by the addition of alkali or alkaline earth metals or their compounds to the resistive material forming the electrode. When the percentage by weight of $SiO_2$ is 0.8%, the resistivity is increased to almost 1,150 ohm-centimeters thereby causing substantial decrease in interference signals up to frequencies of approximately 1 GHz.

The time required for breakdown of the gap and creation of the full spark is increased, thereby again decreasing interference signals, by creation of a surface discharge gap which allows a decrease in the voltage required for ignition and a rounding off of the breakdown region, causing a decrease in interference signals particularly for frequencies above 100 MHz. Use of an auxiliary electrode connected to a reference potential and, in particular, to ground or chassis potential also causes a decrease in the breakdown velocity and a corresponding decrease in the high frequency interference level.

The electrode can also be constructed as a layered electrode including a plurality of resistance elements and a plurality of highly conductive sections, each of the highly conductive sections connecting two neighboring resistance elements to each other. The electrode in itself therefore constitutes an RC low pass filter.

Preferably, the electrode consists of a ceramic mixture and a metal powder finely dispersed throughout the mixture.

DRAWINGS ILLUSTRATING PREFERRED EMBODIMENTS

Figure 1:
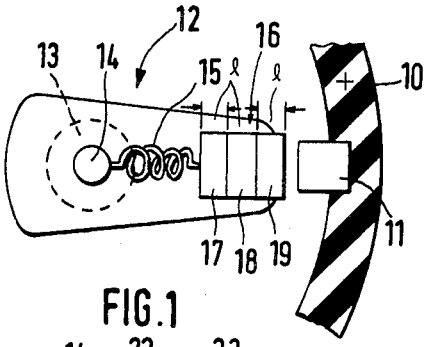
FIG. 1 is a top view of a first preferred embodiment of a distributor electrode and a part-sectional view of a distributor cap.

Part of a distributor as utilized in the ignition system of an internal combustion engine is shown in FIG. 1. A distributor cap 10 is made of insulating material and has a fixed electrode 11 fastened thereto. The distributor rotor 12 is also made of insulating material and is mounted on a distributor shaft 13 for rotation therewith. A center electrode (not shown) is carried by rotor 12 and is electrically connected to a center terminal or contact 14. Center contact 14 is electrically connected through a choke 15 to the distributor electrode 16. The distributor electrode 16 is made of a semiconductor material which cannot be consumed by the spark. In accordance with a feature of the invention, electrode 16 is constructed of three sections 17–19, each having a different resistivity. Section 19, which is in the breakdown region and is referred to as a spark gap section, has the highest length-dependent resistance, namely a resistance of at least 400 ohms per millimeter. The resistance per unit length of sections 17 and 18 is smaller than that of section 19, the total resistance of the rotor electrode 16 lying in the region between 0.5 and 1.0 kiloohms. More specifically, the resistance per unit length of sections 17, 18, 19 increase in that order, i.e. section 17 has the lowest resistance per unit length, section 19 the highest. The thickness of the individual sections is determined by the requirement that the resistance of each section must not be so high and its thickness not so thin that breakdown occurs in section 19 when the spark passes from distributor electrode 16 which acts as a cathode to fixed electrode 11 which acts as anode. Preferably the resistance per unit length of fixed electrode 11 has at least the same minimum value as that of electrode 16, in this case being 400 ohm per millimeter. The total resistance of electrode 11 is at least 1.0 kiloohm.

Specific values for the sections 17, 18 and 19 in a preferred embodiment are as follows:

| Section | length l (mm) | resistance 'R' (Ohm) | resistance per unit length (Ohm/mm) |
|---|---|---|---|
| 17 | 1.0 | 200 | 200 |
| 18 | 0.5 | 175 | 350 |
| 19 | 0.25 | 125 | 500 |

The use of materials having a positive temperature coefficient is particularly advantageous for resistance electrodes used in automobiles. For low temperatures, that is less than 50° C., such materials have a low resistance value and therefore cause a relatively small loss of ignition energy thereby improving the starting characteristics of the automobile. In operation, the positive temperature coefficient resistance heats to the value of approximately one kiloohm which is required for decreasing interference. Positive temperature coefficient resistors made of silicon (silistors) are particularly advantageous because they have the necessary dielectric strength and do not tend to burn off when exposed to the spark.

The semiconductor material for electrodes 11 and 16 may comprise 45 to 88 mol% $Al_2O_3$, 10 to 50 mol% $Cu_2O$, 2 to 5 mol% $Cr_2O_3$ and up to 1% by weight of $SiO_2$ if desired. A ceramic of 78 mol% $Al_2O_3$, 19 mol% $Cu_2O$, 3 mol% $Cr_2O_3$ to which is added 0.2% by weight of $SiO_2$ has a resistivity of approximately 500 ohm-centimeters If the cross section of the electrode of 500 ohm-centimeters is 10 sq. millimeters, and a total resistance of 1 kiloohm is desired, an electrode length of two millimeters results.

For a consistent decrease in interference signals, an electrode with high resistance to burning off is desired, as well as one having small variations with respect to changes in voltage and with respect to temperature changes for temperatures exceeding 50° to 60° C. It is therefore particularly desirable that the resistance material constituting the electrode be as homogeneous as possible which, in turn, requires that all components of the ceramic mixture are fine grained. If the amount of $SiO_2$ is increased from 0.2% by weight to 0.08% by weight, the resultant ceramic mixture causes a decrease in interference up to frequencies of 1.0 GHz. If sodium doping is desired, this can be accomplished by mixing in sodium silicate glass instead of silicon dioxide.

If fixed electrode 11 is made of the above-described material and, in particular, with the specified electrical values, then the speed of spark breakthrough is decreased by approximately 40% thereby effecting a very substantial decrease in interference. The mixture described above is pressed at 1,000 bar and thereafter sintered at 1,250° Celsius for two hours.

A finely dispersed additive of metallic conductivity is added to the ceramic material. This finely dispersed additive is a metallic powder, preferably palladium or platinum. However, nickel or a mixture of palladium and silver can also be utilized. The percentage of metal in the electrode is in the region of 0.01% to 20% by volume.

Figure 2:
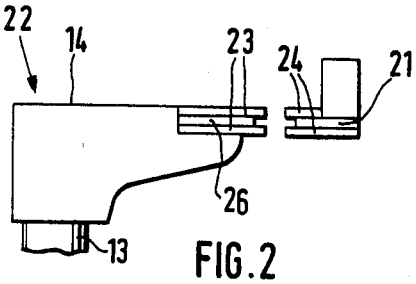
FIG. 2 is a side view of a second preferred embodiment of a distributor electrode.
Figure 3:
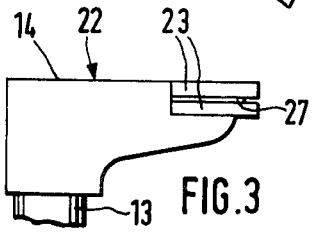
FIG. 3 is a side view of a variation of the electrode shown in FIG. 2.

Embodiment of FIG. 2: Both the distributor electrode assembly on distributor rotor 22 and fixed electrode 21 are equipped with members which will create a surface discharge gap. These members are two plates 23, 24 which cover the top and bottom surfaces of the electrode 26 itself and project past the electrode 26 in the direction of the creepage spark gap, so that two creepage spark gaps or surface discharge gaps are created. Electrode 26, from which the spark fires, is similar to electrode section 19, i.e. has a resistance of at least 400 ohms per mm, and an overall resistance of at least 0.5 kOhms. Plates 23 and 24 are made of an insulating ceramic material, preferably $Al_2O_3$. The construction shown in FIG. 3 differs from that in FIG. 2 in that distributor electrode 27 is applied as a thick layer onto plates 23 made of insulating ceramic. If one creepage spark gap suffices, only one plate 23 or 24 need be used.

Figure 4:
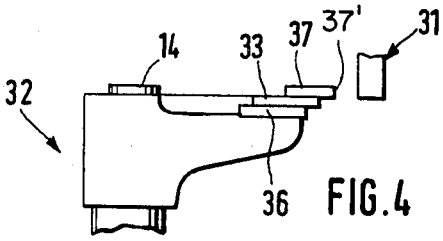
FIG. 4 is a side view of a fourth embodiment of a distributor electrode.

FIG. 4 shows distributor rotor 32 with a capacitor-type electrode with surface discharge gap creating members, as well as a fixed electrode 31. The capacitor-type electrode consists mainly of a first electrode 36 which abuts the distributor, a plate 33 made of an insulating ceramic material abutting the upper surface of electrode 36 and a second electrode 37 having a lower surface abutting the upper surface of plate 33. Electrode 37 is made of a resistive material similar to electrode 19, FIG. 1. Electrodes 36 and 37, and plate 33 which constitutes a dielectric therebetween, are arranged at different distances from center contact 14, second electrode 37 being furthest removed from the center contact and therefore projecting furthest into the gap region. The path of the spark extends from contact 14, through electrode 36, along the projecting lower and front sides of dielectric 33, through the projecting end 37' of electrode 37, across the spark gap and finally through fixed electrode 31. Plate 33 is made of $Al_2O_3$ or $Si_3N_4$.

If the fixed electrode 41 is also made of a resistive material rather than of a highly conductive material, then a further decrease in interference results, since the breakthrough speed is particularly low.

Figure 5:
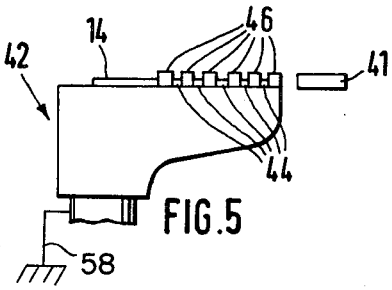
FIG. 5 is a side view of a fifth embodiment of a distributor electrode.

The distributor rotor 42 of FIG. 5 carries an electrode. The latter a so-called multilayered electrode which comprises a plurality of resistance elements 46 and highly conductive sections 44 connecting each two neighboring resistance elements 46. Fixed electrode 41 is made of a material which is electrically resistive and does not tend to burn off when exposed to the action of the spark. Since the rotor shaft of the distributor is connected to ground or chassis, as schematically shown at 58, a capacitative effect will be obtained, as discussed below.

Figure 6:
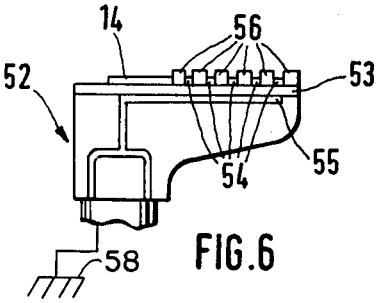
FIG. 6 is a side view of a sixth embodiment of a distributor electrode.
Figure 7:
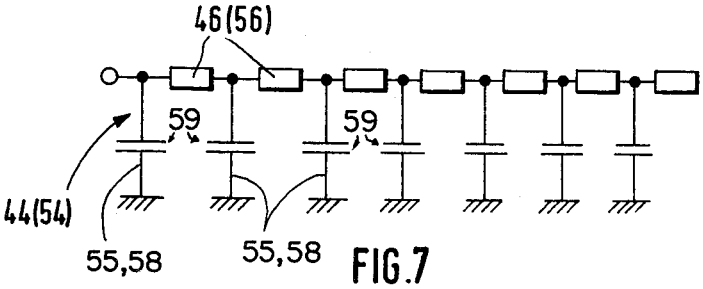
FIG. 7 shows the equivalent circuit for the electrode shown in FIGS. 5 and 6.

Distributor rotor 52 of FIG. 6 also carries a multilayered electrode which has resistance elements 56, conductive sections 54 abd is conductively connected to center contact 14. Further, an auxiliary electrode 55 is provided electrically separated from sections 54 and elements 56 by a ceramic plate 53. This electrode 55 is connected to reference potential, as shown via the distributor shaft to either chassis potential or ground potential schematically shown at 58. The dielectric between auxiliary electrode 55 and multilayered electrode 54, 56 is formed by a layer of insulating ceramic of $Al_2O_3$ and is indicated as a plate 53. The conductive and resistance elements 46, 56, with the grounded shaft or plate 55, form a distributor capacitor having capacitor sections 59 (FIG. 7). The multilayered electrode can be produced by a screen print process.

FIG. 7 shows the equivalent circuit for the multilayered electrodes shown in FIGS. 5 and 6. Each resistance element 46, 56 forms an RC circuit with the adjacent conductive section 44, 54. Resistance elements 46, 56 are connected in cascade so that the RC elements form a low pass filter. This, of course, removes the higher frequencies which result in the interference signals.

When the RC elements are manufactured by a silk screen print process, only the outermost resistance layer need be made of burnproof resistive material, since only this section is subjected to the spark generated across the gap.

Various changes and modifications may be made within the scope of the inventive concepts.

We claim:

1. Electrical interference suppressed spark apparatus, paticularly distributor for an internal combustion engine, to provide a spark across a spark gap, comprising a first electrode (11);

and a second electrode (16) separated from said first electrode by a spark gap, said second electrode comprising a plurality of sections (17, 18, 19) in a direction of propagation of said spark, said plurality of sections including a spark gap section (19) closest to said spark gap, said spark gap section (19) closest to the spark gap having a predetermined resistance per unit length of at least 400 ohms per millimeter in the direction of propagation of said spark.

2. Spark apparatus as set forth in claim 1, wherein the total resistance of said second electrode is at least 0.5 kiloohms.

3. Spark apparatus as set forth in claim 1, wherein the total resistance of said second electrode is between 0.5 and 1.0 kiloohms.

4. Apparatus as set forth in claim 3, wherein each of said plurality of sections of said second electrode has a different resistance per unit length, said spark gap section (19) closest to said spark gap having a highest resistance per unit length.

5. Electrical interference suppressed spark apparatus, particularly distributor for an internal combustion engine, to provide a spark across a spark gap, comprising a first electrode (11, 21, 31, 41);

and a second electrode (16, 26, 27, 37, 44, 46, 54, 56) separated from said first electrode by said spark gap, said second electrode having an end part adjacent said spark gap, and wherein at least said end part has a minimum resistance per unit length of at least 400 ohms per millimeter.

6. Spark apparatus as set forth in claim 5, wherein said second electrode is made of a material having a positive temperature coefficient above a predetermined minimum temperature.

7. Spark apparatus as set forth in claim 6, wherein said material is a silicon.

8. Spark apparatus as set forth in claim 5, wherein said second electrode is made of ceramic material comprising 10–50 mol% $Cu_2O$, 45–88 mol% $Al_2O_3$, 2–5 mol% $Cr_2O_3$ and additionally 0–1% by weight of $SiO_2$.

9. Spark apparatus as set forth in claim 8, wherein said second electrode is made of ceramic material comprising 78 mol% $Al_2O_3$, 19 mol% $Cu_2O$, 3 mol% $Cr_2O_3$ and additionally at least 0.2% by weight $SiO_2$.

10. Spark apparatus as set forth in claim 9, wherein the percentage by weight of $SiO_2$ is 0.8%.

11. Spark apparatus as set forth in claim 5, further comprising means (23) arranged on said second electrode (26) for creating a surface discharge gap.

12. Spark apparatus as set forth in claim 11, wherein said means for creating a surface discharge gap comprises a plate (23) of insulating ceramic.

13. Spark apparatus as set forth in claim 12, wherein said plate is made of $Al_2O_3$.

14. Spark apparatus as set forth in claim 11, wherein said means for creating a surface discharge gap comprises a first and second plate (23, 23) of insulating ceramic; and wherein said surface discharge gap includes a thick film between said first and second plates.

15. Spark apparatus as set forth in claim 5, wherein said second electrode comprises a plurality of high resistance sections 46, (56) and a plurality of highly conductive sections 44, (54), each of said highly conductive sections connecting two adjacent resistive sections.

16. Spark apparatus as set forth in claim 15, further comprising an auxiliary electrode (55) connected to reference potential, and an insulating layer (53) separating said second auxiliary electrode and said electrode sections.

17. Spark apparatus as set forth in claim 15, wherein said electrode is manufactured by a screen printing process.

18. Spark apparatus as set forth in claim 5 wherein said electrode is made of a mixture of resistive ceramic material and a finely dispersed additive having a high conductivity.

19. Spark apparatus as set forth in claim 18, wherein said finely dispersed additive is a metal powder.

20. Spark apparatus as set forth in claim 19, wherein said metal powder is platinum and/or palladium and/or nickel.

21. Spark apparatus as set forth in claim 19, wherein said metal powder is a mixture of palladium and silver.

22. Spark apparatus as set forth in claim 19, wherein said metal powder constitutes between 0.01 and 20% by volume of said electrode.

23. Spark apparatus as set forth in claim 5, further comprising a distributor rotor, and a center contact (14) mounted on said distributor rotor, and wherein the second electrode comprises an additional electrode part (36) abutting said distributor rotor, and a plate (33) of insulating ceramic abutting said additional electrode part;

wherein said end part (37) abuts said insulating ceramic plate (33);

and said additional electrode part (36), plate (37), and end part (37) are located at respective first, second and third predetermined distances from said center contact (14), said first, second and third predetermined distances increasing in that order.

24. Spark apparatus as set forth in claim 5, wherein the total resistance of said second electrode is at least 0.5 kiloohms.

25. Spark apparatus as set forth in claim 5, wherein the total resistance of said second electrode is between 0.5 and 1.0 kiloohms.

* * * * *

UNITED STATES PATENT AND TRADEMARK OFFICE

CERTIFICATE OF CORRECTION

PATENT NO. : 4,393,282

DATED : July 12, 1983

INVENTOR(S) : Werner GRUNWALD et al

It is certified that error appears in the above—identified patent and that said Letters Patent is hereby corrected as shown below:

Claim 4, Col. 5, line 31, change "Apparatus as set forth in claim 3" to read -- Apparatus as set forth in claim 1 --

Signed and Sealed this

*Fifteenth* Day of *November 1983*

[SEAL]

*Attest:*

GERALD J. MOSSINGHOFF

*Attesting Officer*

*Commissioner of Patents and Trademarks*